US006766973B2

(12) United States Patent
Muri

(10) Patent No.: US 6,766,973 B2
(45) Date of Patent: Jul. 27, 2004

(54) CONCRETE CRUSHING GRAPPLER

(76) Inventor: Franz Muri, Schutz 35, 6022, Grosswangen (CH)

( * ) Notice: Subject to any disclaimer, the term of this patent is extended or adjusted under 35 U.S.C. 154(b) by 16 days.

(21) Appl. No.: 10/169,388

(22) PCT Filed: Dec. 22, 2000

(86) PCT No.: PCT/CH00/00686

§ 371 (c)(1),
(2), (4) Date: Nov. 26, 2002

(87) PCT Pub. No.: WO01/49945

PCT Pub. Date: Jul. 12, 2001

(65) Prior Publication Data

US 2003/0132327 A1 Jul. 17, 2003

(30) Foreign Application Priority Data

Dec. 30, 1999 (GB) ..... 99812219

(51) Int. Cl.[7] ..... A01D 34/00; B02B 5/02
(52) U.S. Cl. ..... 241/101.73; 241/294; 30/134
(58) Field of Search ..... 241/101.71, 101.73, 241/266, 294, 300; 30/134

(56) References Cited

U.S. PATENT DOCUMENTS 4,838,493 A 6/1989 LaBounty
4,934,616 A * 6/1990 Zepf ..... 241/266
4,951,886 A * 8/1990 Berto ..... 241/101.73
5,183,216 A 2/1993 Wack
5,292,079 A * 3/1994 Zakohji ..... 241/264
5,301,882 A 4/1994 Morikawa et al.
5,385,311 A * 1/1995 Morikawa et al. ..... 241/266
5,474,242 A 12/1995 Rafn
5,822,893 A 10/1998 Ostermeyer
5,926,958 A * 7/1999 Ramun ..... 30/134
5,992,023 A 11/1999 Sederberg et al.

FOREIGN PATENT DOCUMENTS

| | | |
|---|---|---|
| EP | 0 666 131 | 8/1995 |
| EP | 0 666 131 A1 | 9/1995 |
| EP | 0 755 742 | 1/1997 |
| EP | 0 755 742 A1 | 1/1997 |
| EP | 0 770 164 B1 | 10/1998 |

* cited by examiner

*Primary Examiner*—Ed Tolan
(74) *Attorney, Agent, or Firm*—Oliff & Berridge, PLC

(57) ABSTRACT

Concrete-crushing pincers comprise a first pincer jaw and a second pincer jaw which are swivelingly connected to one another via a joint and which are movable from an open position into a closed position for demolishing a concrete structural member reinforced with reinforcing irons. The first pincer jaw is formed by a frame body. The second pincer jaw is formed by a body. The first pincer jaw and the second pincer jaw have concrete-crushing sectors and cutting elements. The cutting elements are detachably fastened in the first pincer jaw and the second pincer jaw and can be exchanged.

14 Claims, 9 Drawing Sheets

CONCRETE CRUSHING GRAPPLER

FIELD OF THE INVENTION

The present invention relates to concrete-crushing pincers.

Concrete-crushing pincers are utilized for demolishing structures made of reinforced concrete. In this connection, it is particularly desirable that through the pincer movement of the concrete-crushing pincers, the concrete is crushed, on the one hand, and the reinforcing iron is cut in the same course of movement, on the other hand. The demolition material thus broken up can thereby be fed for further processing to, for example, a breaker in which separation of concrete and metal takes place, without any additional working operation, such as severing reinforcing iron with a cutting torch if it is not optimally cut by the concrete-crushing pincers.

Such concrete-crushing pincers are known. Thus, for example, such concrete-crushing pincers are shown in U.S. Pat. No. 5,183,216. These concrete-crushing pincers also comprise, besides the crushing teeth, cutting elements which are held in rectangular-shaped recesses. During cutting of the reinforcing irons, these cutting elements are subjected to high stresses. Areas of the rectangular-shaped recesses may thereby be excessively stressed, which may result in deformation. This leads to damage of the recesses, which must be eliminated by expensive repair work.

In European Patent No. 0 770 164, concrete-crushing pincers are shown which have two pincer jaws, each of which is provided with concrete-crushing sectors and cutting edges. The concrete-crushing sectors project over the cutting edges, to avoid crushing of the concrete by the cutting edges which are provided for cutting the reinforcing iron and should therefore have a relatively sharp edge. The concrete-crushing edge and the cutting edge are rotary, i.e., in order to be able to cut the reinforcing iron optimally, the concrete-crushing edge must not project too far over the cutting edge. The cutting edge is also highly stressed by the crushing of the concrete, which may result in heavy wear and tear and expresses itself in decreasing cutting quality for the reinforcing iron.

Since the cutting edges are exposed to high forces of traction and compression during cutting of the reinforcing iron, the respective cutting elements must be optimally joined to the respective pincer jaw. In these previously described concrete-crushing pincers, this is achieved in that the material forming the cutting edge is welded onto the pincer jaw. This has the drawback, however, that in case of wear of this cutting edge, new material must be welded on, which usually takes place in a workshop, whereby the pincers are not in operation for some time, and long downtimes occur. Furthermore, additional material cannot be welded onto the pincer jaw as often as desired since structural modifications of the material occur through the heating, whereby the strength of this material and hence the connection between welded-on material and pincer jaw is no longer optimal and the additional material may break off.

SUMMARY OF THE INVENTION

A task of the present invention now consists in creating concrete-crushing pincers in which the renewal of the cutting edges may be carried out without requiring long stoppage times, and in which optimum crushing of the concrete is achieved.

According to the invention, the solution of this task takes place by means of the following features. Concrete-crushing pincers having a first pincer jaw and a second pincer jaw are connected to one another via a joint and are movable via hydraulic cylinders about a swivel axis formed by the joint from an open position into a closed position. The first pincer jaw is formed by a frame body in which first concrete-crushing sectors and first cutting sectors are disposed. The second pincer jaw is formed by a body on which second concrete-crushing sectors and second cutting sectors are disposed, which, during closing of the concrete-crushing pincers, while the second pincer jaw penetrates into the frame body of the first pincer jaw, cooperate with the first concrete-crushing sectors and the first cutting sectors of the first pincer jaw. The first and the second cutting sectors are each formed of first and second cutting elements, respectively, which are inserted in receiving pockets affixed in the first pincer jaw and the second pincer jaw and are detachably fastened therein, such that the first cutting elements are fastened to the lateral areas of the first pincer jaw and the second pincer jaw. The first cutting elements are each formed of a block provided with a bend, the convex surface of which rests in the receiving pocket provided with a corresponding support surface, and the concave surface of which, with the lateral surfaces lying in a plane standing perpendicular to the swivel axis, each form a cutting edge.

By allowing the cutting elements of the concrete-crushing pincers to be exchanged, which can practically be undertaken at the place of use of these concrete-crushing pincers, long stoppage times are avoided.

In this connection, first cutting elements, each formed of a block provided with a bend, are fastened to the lateral areas of the first pincer jaw and of the second pincer jaw. Moreover, their convex surface rests in the receiving pocket of the pincer jaw provided with a corresponding support surface, whereas their concave surfaces each form a cutting edge with the lateral surfaces lying in a plane standing perpendicular to the swivel axis. Besides the advantage that these individual blocks can be very quickly replaced, it is thereby also achieved that the absorption of the forces during cutting of the reinforcing iron and their transmission to the pincer jaws can take place in an optimal manner.

A further advantageous arrangement of the invention includes a guide rib that is affixed to the convex surface of the previously described block, which guide rib is aligned longitudinally to the convex surface and runs centrally, the respective support surface of the receiving pocket being equipped with a groove corresponding to the guide rib, in which groove the guide rib engages when the block is inserted in the pincer jaw. By means of this device, the block is held optimally in the receiving pocket of the respective pincer jaw.

A further advantageous arrangement of the invention includes elements that are affixed to the end regions of the support surfaces of the receiving pockets, which elements are provided with stop surfaces against which the end faces of the blocks rest when inserted in the receiving pockets. By this means, these blocks are optimally held in the receiving pockets. Since the blocks themselves are not connected to the pincer jaw, for instance with screws, no excessive stress peaks arise through the forces occurring during the cutting operation, which stress peaks might for instance lead to breaking of the screws, since the forces can be optimally led over into the pincer jaw.

Advantageously, first cutting elements formed by the blocks are provided, disposed two at a time in a row on each lateral area of the pincer jaws, which elements are held in the receiving pockets by teeth screwable onto the pincer jaw.

The tips of the teeth project over the cutting edges of the cutting elements, whereby the crushing of the concrete is at least initiated by these teeth, and the cutting edges are thus spared.

A further advantageous arrangement of the invention includes the bend of the block forming the cutting elements is arcuate, whereby the bearing surface is optimal, and the fabrication of the blocks and the receiving pockets is simplified. The concave surface of the blocks situated between the two cutting edges has a curvature, and the wedge angle of the cutting edge becomes greater than 90°. During cutting of the reinforcing iron, the latter thus rests first upon the curvature, it is pressed straight before the cutting edges engage, whereby again the cutting edges are protected. Through the symmetrical arrangement of these blocks, this block can be rotated in the receiving pocket in such a way that one of the two cutting edges is in use each time, whereby the material is optimally utilized.

A further advantageous arrangement of the invention includes a plate forming the second cutting element that is affixed to the end-face area of the first and the second pincer jaw, respectively, which plate rests with one lateral area each on a corresponding support surface of the receiving pocket, and optimum transmission of force to the pincer jaw is thus achieved.

The rear side of this plate is supported against a wall, adjoining the support surface, of the first pincer jaw and the second pincer jaw, respectively, and is screwed to the latter. Thus this plate is also easily exchangeable.

Advantageously, the two lateral surfaces of the plate are provided with indentations and projections, along which the cutting edge runs. The plate may be inserted in the receiving pocket in such a way that either one or the other of the two cutting edges is in use. By this means, too, the material is optimally utilized.

A further advantageous arrangement of the invention includes the plate being disposed between the two front teeth of the first and/or second pincer jaw, respectively, with the tips of the teeth projecting over the cutting edge of the plate. The crushing of the concrete is thereby again at least initiated over the teeth, and the cutting edge of the plate is spared as a result.

In order that the concrete may be crushed optimally and the cutting edges of the cutting elements may be protected, additional teeth are affixed to the second pincer jaw, and these teeth are disposed between each of two teeth forming a pair and project over their tips. During demolishing of reinforced concrete, the area grasped by the pincers is first subjected to bending stress, and the concrete thus breaks more easily.

Advantageously, the teeth are disposed in the pincer jaws so that upon closing of the pincers, first the rear teeth come in contact with the portion of concrete to be broken off, and the concrete is crushed in this sector, and only thereafter do the front teeth engage. The crushing of the concrete thereby becomes easier.

An embodiment of the present invention is described in detail below, by way of example, with reference to the enclosed drawings.

DETAILED DESCRIPTION OF THE INVENTION

Figure 1:
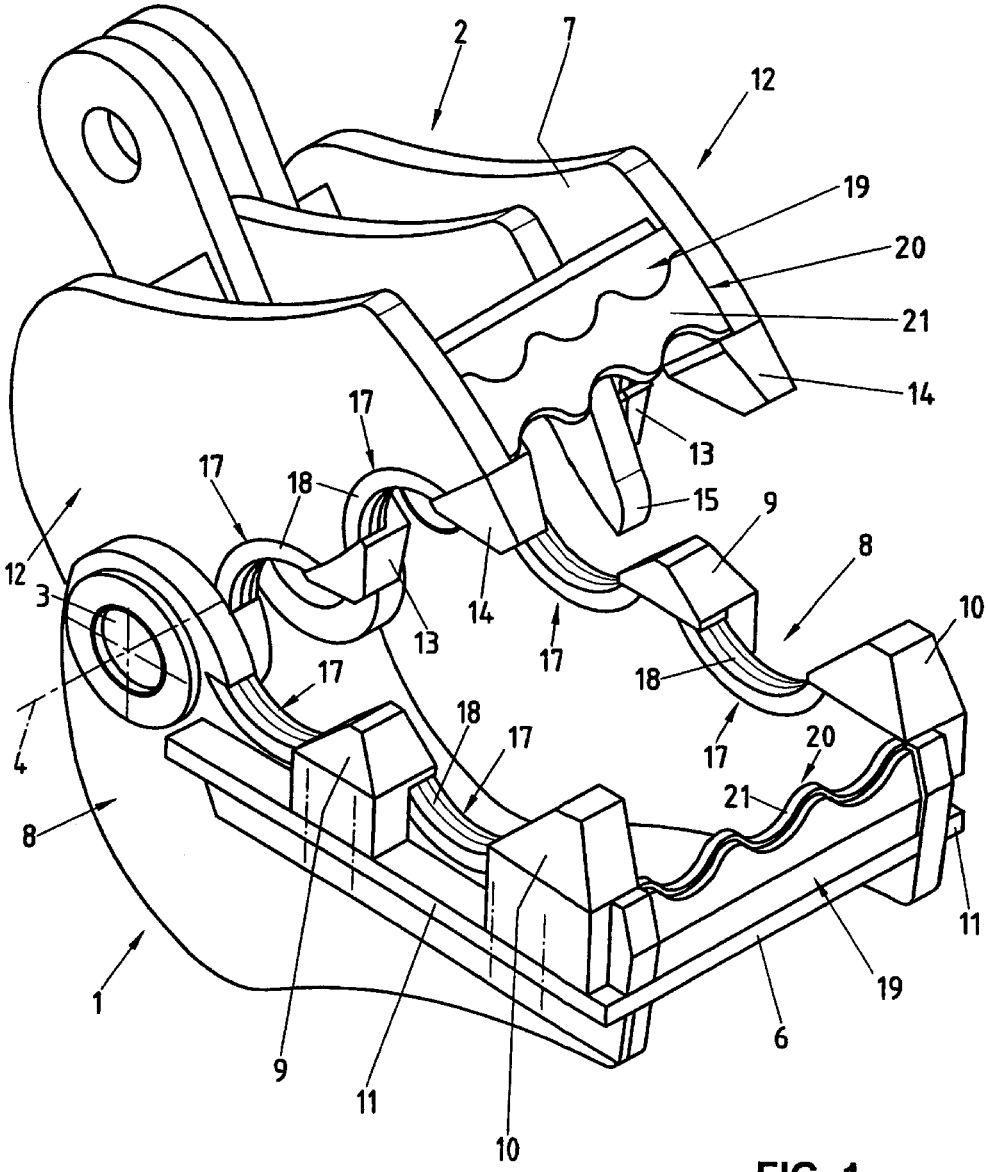
FIG. 1 shows an embodiment of the concrete-crushing pincers according to the invention in a perspective view.
Figure 9:
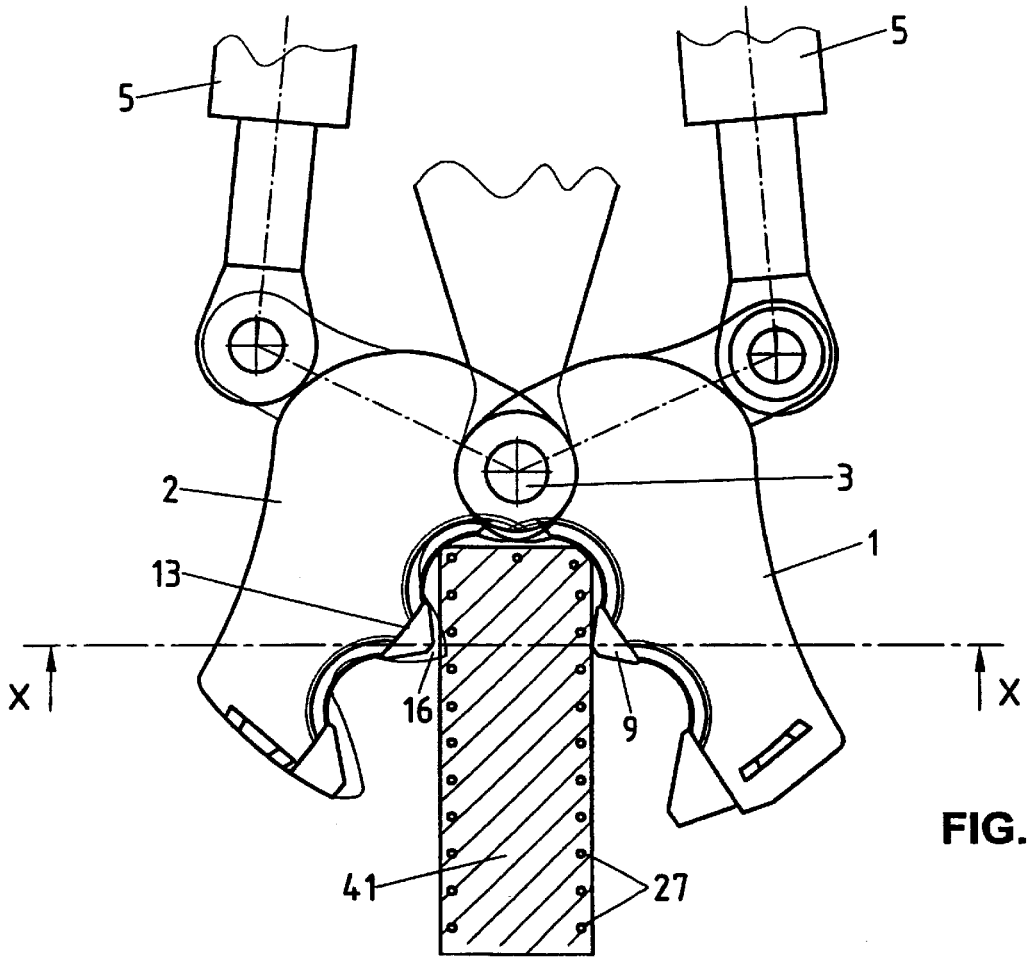
FIG. 9 shows a diagrammatical view of the opened concrete-crushing pincers which have just engaged a reinforced concrete portion during the closing operation.
Figure 10:
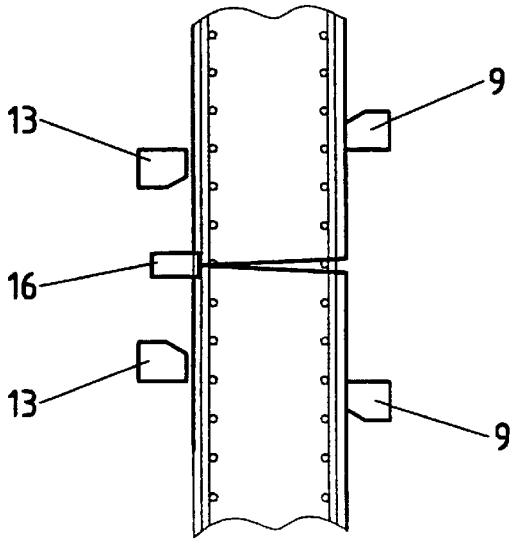
FIG. 10 shows diagrammatically a sectional view taken on the line X—X according to the situation of FIG. 9.

As shown in FIG. 1, the concrete-crushing pincers consist of a first pincer jaw 1 and a second pincer jaw 2. These first pincer jaw 1 and second pincer jaw 2 are connected to one another via a joint 3 and are movable about a swivel axis 4 formed by the joint 3 from an open position, as is shown in FIG. 1, into a closed position. This opening and closing of the concrete-crushing pincers takes place in a known manner by means of hydraulic cylinders 5, which are shown diagrammatically by way of example in FIG. 9. These concrete-crushing pincers may be fastened in the usual manner to a construction machine, and may be brought into any desired position thereby, while the hydraulic cylinders 5 are controllable via a hydraulic unit provided in these construction machines.

The first pincer jaw 1 of these concrete-crushing pincers is formed by a frame body 6 which has a free passage on the inside. The second pincer jaw 2 is formed by a body 7 which, upon closing of the concrete-crushing pincers, can penetrate into the frame body 6 of the first pincer jaw 1.

The first pincer jaw 1 has first concrete-crushing sectors which each consist of a rear tooth 9 and a front tooth 10 affixed to the lateral areas 8 of the first pincer jaw 1. The rear teeth 9 and the front teeth 10 of the first pincer jaw 1 are screwed onto a crosspiece 11 affixed to the outside of frame body 6. The rear teeth 9 and the front teeth 10 may thereby be taken out of the first pincer jaw 1 and reinserted and/or exchanged. Affixed to the lateral areas 12 of the second pincer jaw 2 is likewise a rear tooth 13 and a front tooth 14 each, which serve as concrete-crushing sectors and which are fastened by screwing to a crosspiece, not shown, which is affixed to the inside of the second pincer jaw. Centrally between the two front teeth 14 of the second pincer jaw 2, an additional tooth 15 is affixed. This additional tooth 15 projects over the two front teeth, the effect achievable thereby will be described in detail later. Likewise affixed between the rear teeth 13 of this second pincer jaw 2 is an additional tooth 16 which is not visible in FIG. 1 but can be seen in FIG. 17.

Inserted in each case between the joint area and the rear tooth 9, as well as between the rear tooth 9 and the front tooth 10 of the first pincer jaw 1, are first cutting elements 17 formed of an arcuate block 18. This arcuate block 18 and its fastening in the first pincer jaw 1 and the second pincer jaw 2 will be described in detail later.

Fastened to the end-face area 19 of the first pincer jaw 1 and the second pincer jaw 2 are second cutting elements 20 which are formed of a plate 21. These plates 21 will also be described in detail later.

Figure 2:
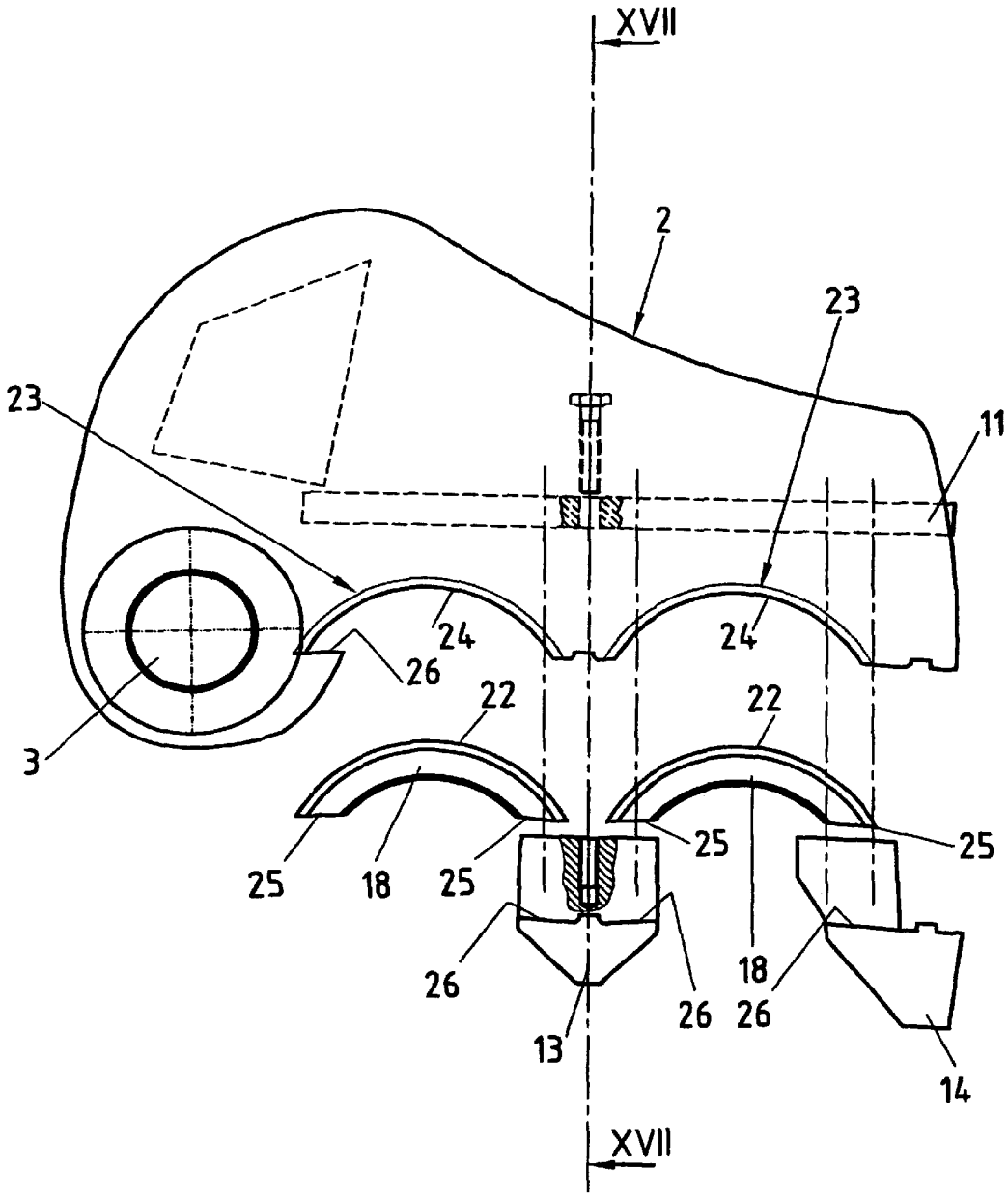
FIG. 2 shows a side elevation of the first pincer jaw with the first cutting elements to be inserted therein and the teeth.

As may be seen from FIG. 2, in which the second pincer jaw 2 is shown, the first cutting elements 17 each consist of an arcuate block 18. The first pincer jaw 1 is formed correspondingly. This block 18 has a convex surface 22 and may be inserted in receiving pockets 23 of the first pincer jaw 1 and/or the second pincer jaw 2 in such a way that the convex surface 22 rests on a corresponding support surface 24 of the receiving pocket 23. The blocks 18 are each held in the receiving pockets 23 at their end faces 25 which rest against stop surfaces 26. These stop surfaces 26 are formed on the one hand by the rear and front teeth 9 and 10 of the first pincer jaw 1 and 14 and 15 of the second pincer jaw 2, while the stop surface 26 situated in the region of the joint 3 is formed integral with the first pincer jaw 1 and the second pincer jaw 2.

Advantageously, spring elements, not shown, for instance plate springs, may be inserted between the end faces 25 of the blocks 18 and the stop surfaces 26, which springs might be placed in corresponding recesses. The blocks would thereby be held biased in the receiving pockets 23, allowing the seat between the convex surfaces 22 of the blocks 18 and the support surfaces 24 to be optimal, even in the case of a possibly occurring elastic deformation of the first pincer jaw 1 and/or the second pincer jaw 2, so that no soiling of the seat could take place.

As may be seen from FIG. 2, the blocks 18 forming the first cutting elements 17 may easily be inserted in the pincer jaw 1 or pincer jaw 2 and fastened by screwing the rear teeth 9, 13 and/or front teeth 10, 14 tightly to the respective pincer jaw 1 or 2. Replacement of these blocks 18 may thus be carried out very quickly, for this purpose even only the rear tooth 9 or 13 need be taken out in each case. The blocks 18 of the first pincer jaw 1 and of the second pincer jaw 2 are identical. Thus, they may be exchanged with each other at will. A mix-up during insertion of the blocks 18 in the pincer jaws 1 and/or 2 is thereby out of the question, and differing wear and tear can be offset by mutual exchange.

Figure 3:
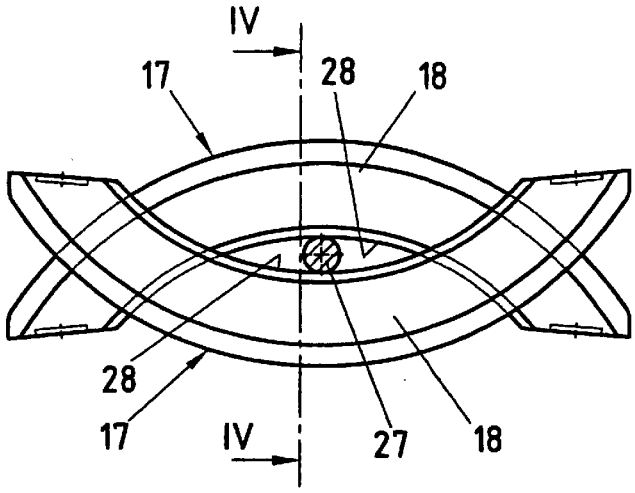
FIG. 3 shows a partial view of the first cutting elements which are in a position just before the cutting of a reinforcing iron.
Figure 4:
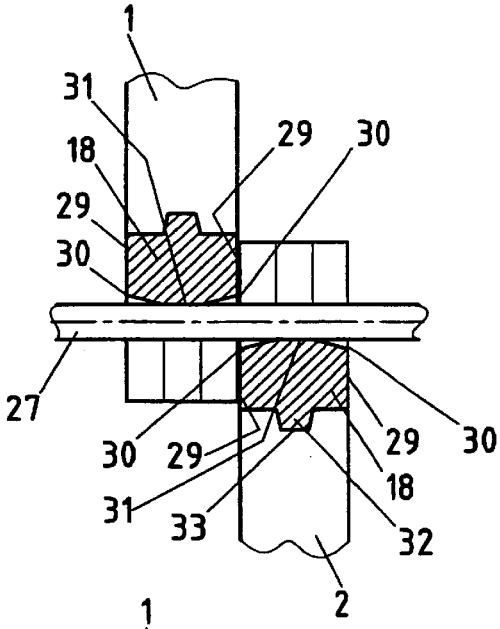
FIG. 4 shows a sectional view taken on the line IV—IV through the first cutting elements according to FIG. 3.
Figure 5:
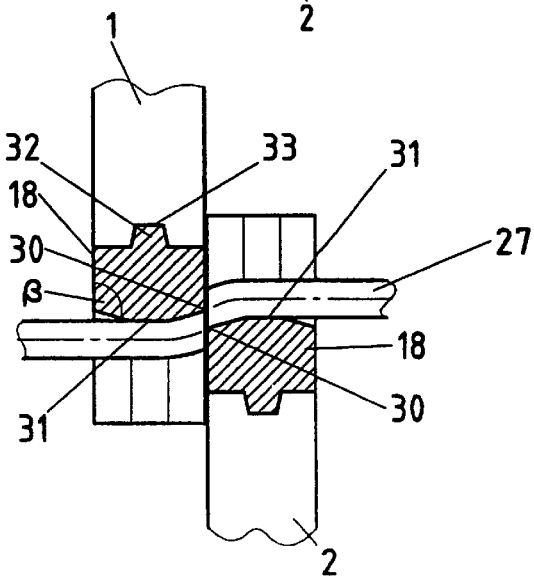
FIG. 5 shows a sectional view corresponding to the sectional view according to FIG. 4, the first cutting elements being in a position of cutting through the reinforcing iron.

The cutting operation with these first cutting elements 17, which are formed by the blocks 18, is shown in FIGS. 3 to 5. Upon closing of the concrete-crushing pincers, the reinforcing iron 27 comes into the region of the concave surfaces 28 of the blocks 18, as will be seen later. The concave surface 28 and the lateral surfaces 29 of the blocks 18 each form a cutting edge 30. The blocks 18 may thus be inserted in the corresponding pincer jaws 1 and/or 2 in such a way that one or the other cutting edge 30 is being used for cutting the reinforcing iron. The concave surface 28 is furnished with a curvature 31, whereby a wedge angle β greater than 90°, preferably about 105°, is produced.

Upon closing of the concrete-crushing pincers, the reinforcing iron 27 first rests upon the curvatures of the co-operating blocks 18, as is seen in FIG. 4. The reinforcing iron 27 is thereby held fast before the cutting edges 30 begin their cutting operation. During the further closing of the concrete-crushing pincers, pulling of the reinforcing iron 27 into the cutting gap is avoided. The forces acting upon the blocks 18 thereby become more favorable. The cutting operation as shown in FIG. 5 takes place optimally since the reinforcing iron 27 to be cut does not have a tendency to become squeezed in the cutting gap, whereby the latter would in turn have a tendency to become expanded. The cutting edges 30 are thereby optimally stressed, and the life of the first cutting elements 17 is extended.

As may be seen particularly from FIGS. 4 and 5, each block 18 is provided in the region of the convex surface 22 with a guide rib 32 which engages a groove 33 that is formed in the respective receiving pocket of the first pincer jaw 1 and the second pincer jaw 2. Optimum holding of the blocks 18 in the respective receiving pockets of the first pincer jaw 1 and the second pincer jaw 2 is thereby obtained.

Figure 6:
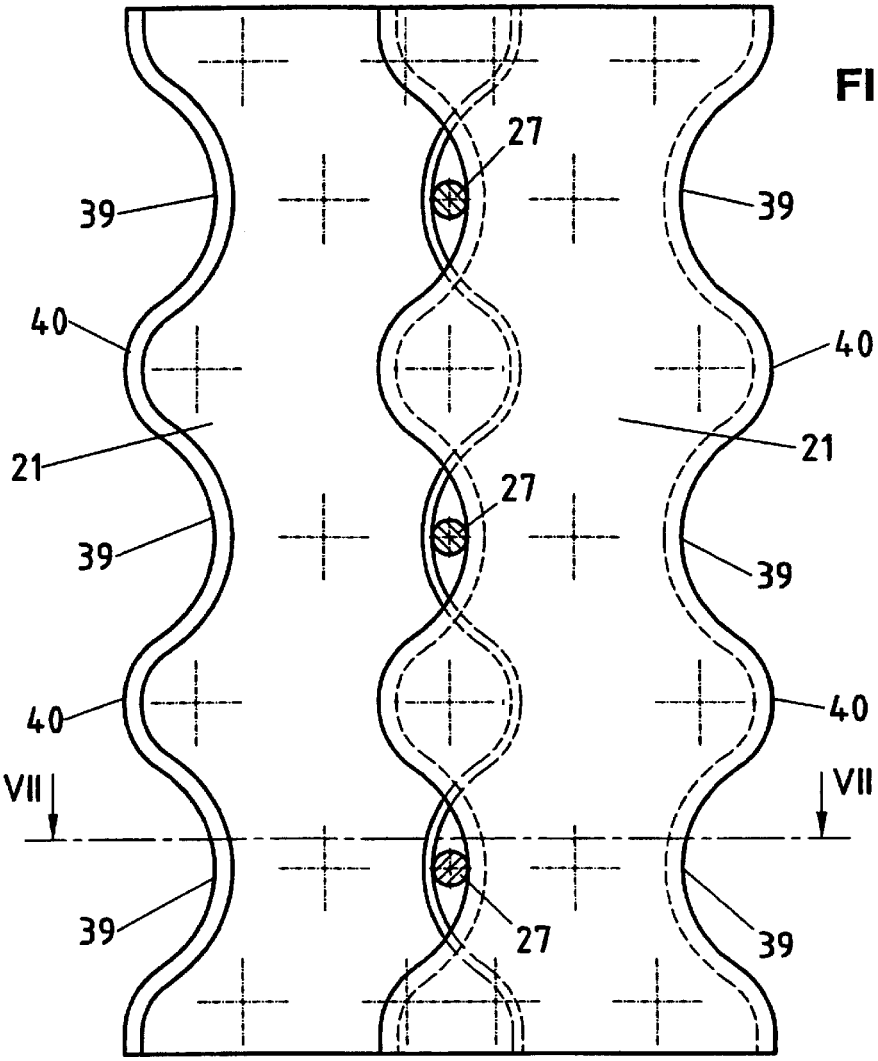
FIG. 6 shows a top plan view of the plates forming the second cutting elements, which plates are in a position just before cutting through the reinforcing iron.
Figure 7:
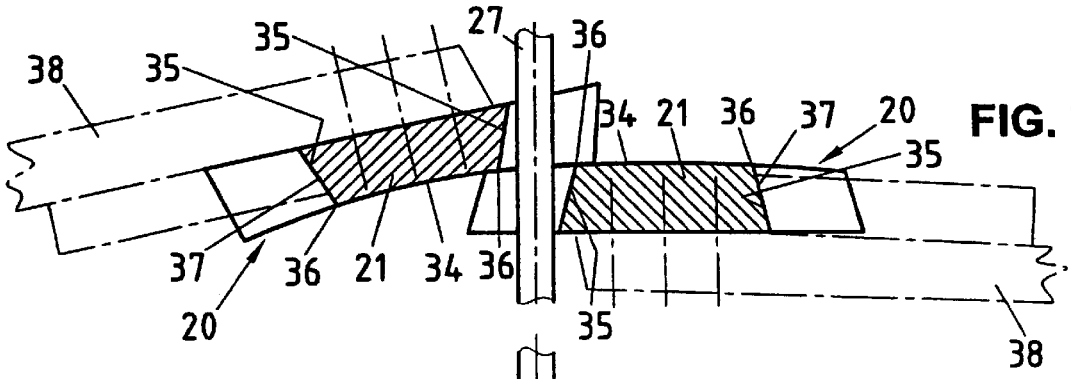
FIG. 7 shows a sectional view taken on the line VII—VII through the second cutting elements depicted in FIG. 6.
Figure 8:
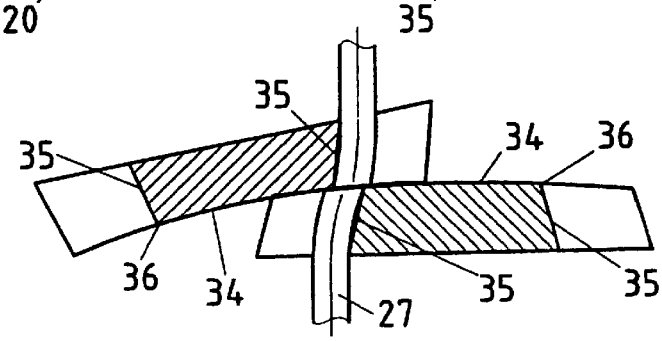
FIG. 8 shows a sectional view through the second cutting elements according to FIG. 7, these plates being in a position during cutting through the reinforcing iron.

As may be seen from FIGS. 6 to 8, the second cutting elements 20 each consists of a plate 21. The particular surface 34 directed toward the cutting plane has a curvature, so that every point of this surface 34 is at the same distance from the swivel axis 4 of the concrete-crushing pincers. The opposing lateral surfaces 35, adjoining this surface 34 provided with a curvature, each form together with this surface 34 a cutting edge 36. One each of the lateral surfaces 35, when inserted in the pincer jaws 1, 2, is supported by a support surface 37 which forms the receiving pocket in the end-face area of the concrete-crushing pincers. The surface of the plate 21 opposite the curved surface 34 rests against a wall 38 of the first pincer jaw 1 and/or the second pincer jaw 2 adjacent to the support surface 37 and is screwed to this jaw. Thus, these plates 21 forming the second cutting elements 20 may also be exchanged in a simple manner. Since the plates 21 are formed symmetrically, they may also be rotated so that one or the other of the cutting edges 36 is in use.

As may be seen particularly from FIG. 6, the lateral surfaces 35 have indentations 39 and projections 40. Upon closing of the concrete-crushing pincers, the reinforcing irons 27 are pushed into the indentations 39 and then clamped fast by the lateral surfaces 35, as is seen in FIG. 7. Upon further closing, the reinforcing irons 27 are cut by the cutting edges 36, with forces acting upon the plates 21 which try to pull the plates together. With this arrangement, too, the cutting gap is thereby not expanded, but the opposite happens, whereby an optimum cutting effect is achieved. Here, too, the edge angle of the cutting edge is greater than 900, preferably about 1050, whereby, as mentioned, the cutting edges are protected.

Figure 17:
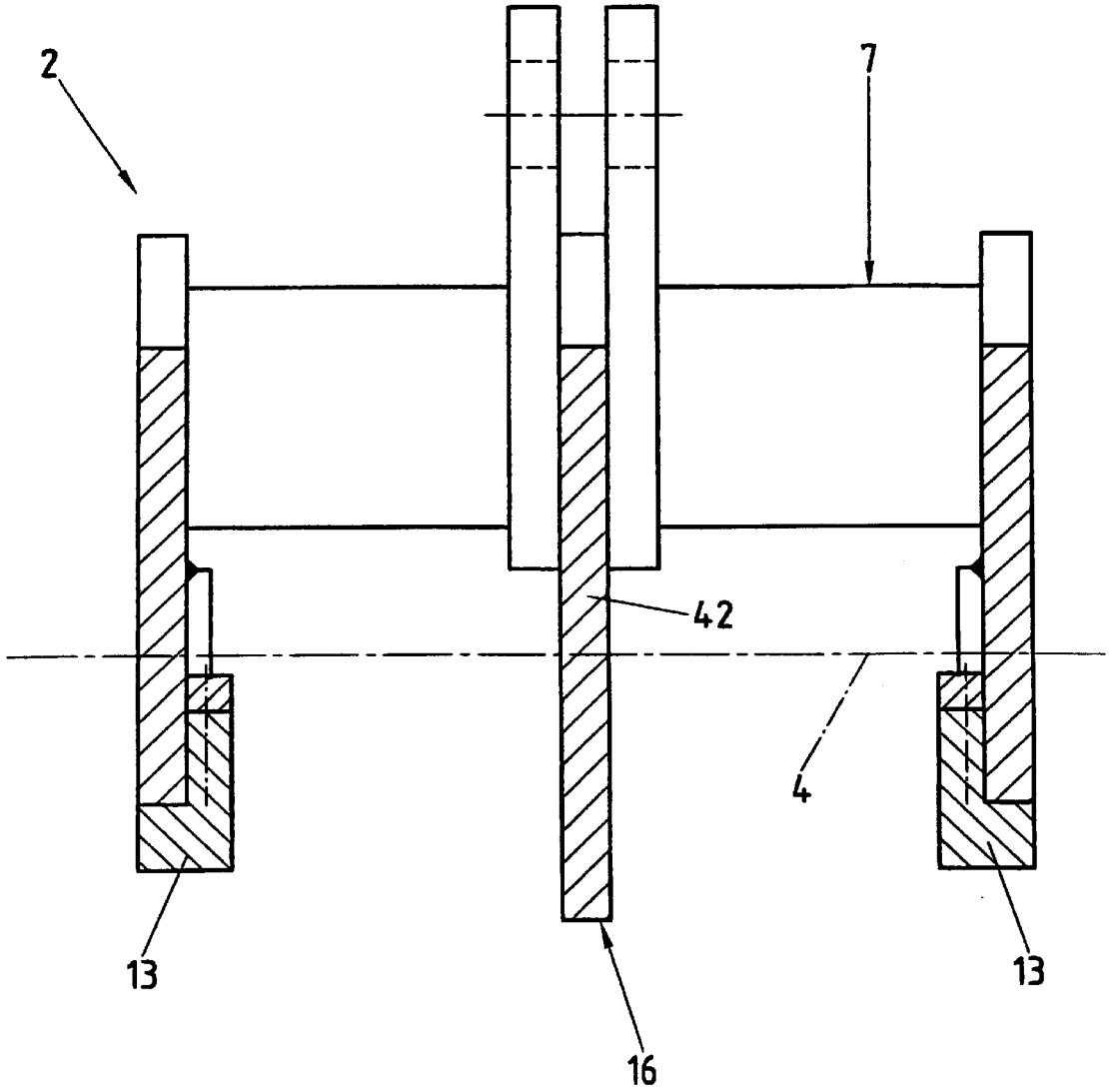
FIG. 17 shows a sectional view through the second pincer jaw taken on the line XVII—XVII according to FIG. 2, with the additional tooth disposed between the rear teeth.

It may be seen from FIG. 17 how the additional tooth 16 in the second pincer jaw 2 is disposed. Affixed about centrally between the two rear teeth 13 in the second pincer jaw 2 is a plate 42 to which the additional tooth 16 is affixed. As already seen in FIG. 1, the additional tooth 15 is also affixed to this plate 42. The additional tooth 16, as may be gathered from FIG. 17, projects over the two rear teeth 13 of the second pincer jaw 2. The additional tooth 15 also projects, as is seen in FIG. 1, over the two front teeth 14 of the second pincer jaw 2. The function of these additional teeth 15 and 16 of the second pincer jaw 2 projecting over the two front teeth 14 and/or over the rear teeth 13 will be described in detail below in connection with the teeth 9 and 10 of the first pincer jaw 1.

With reference to FIGS. 9 to 16, the mode of operation and function of the concrete-crushing pincers according to the invention will be described below. The concrete-crushing pincers, with opened first pincer jaw 1 and second pincer jaw 2, are placed, for example, over a concrete slab 41 reinforced with reinforcing iron 27, as may be seen in FIG. 9. The first pincer jaw 1 and the second pincer jaw 2 are then slowly closed about the joint 3 via the hydraulic cylinder 5. The rear teeth 9 of the first pincer jaw 1 come to bear on the concrete slab 41. The additional tooth 16, which is situated centrally between the rear teeth 13 of the second pincer jaw 2 and projects over the latter, likewise presses on the concrete slab 41. As is seen from FIG. 10, a bending effect is thereby produced on the concrete slab, the concrete begins to break under the bending forces occurring, as is shown diagrammatically in FIG. 10.

Figure 11:
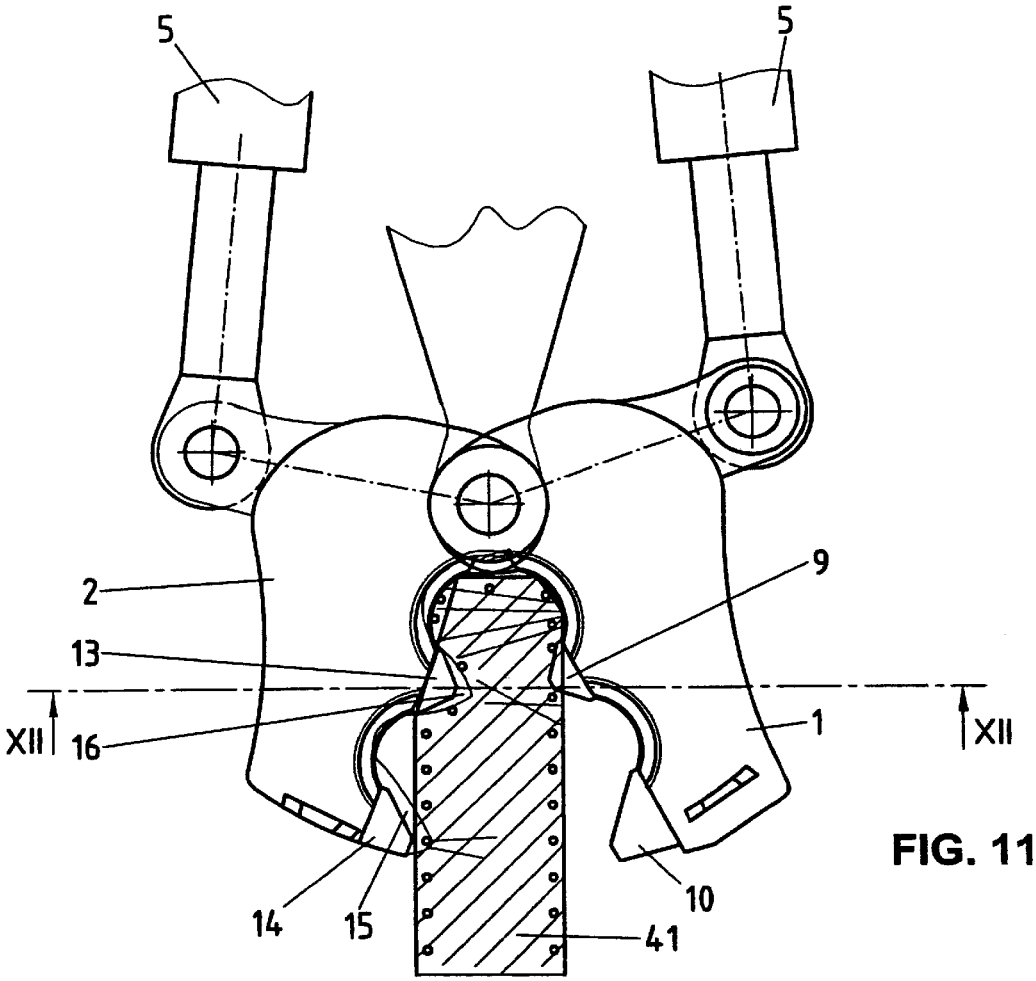
FIG. 11 shows a diagrammatical view of the concrete-crushing pincers, the closing movement of which is advanced as compared with FIG. 9.
Figure 12:
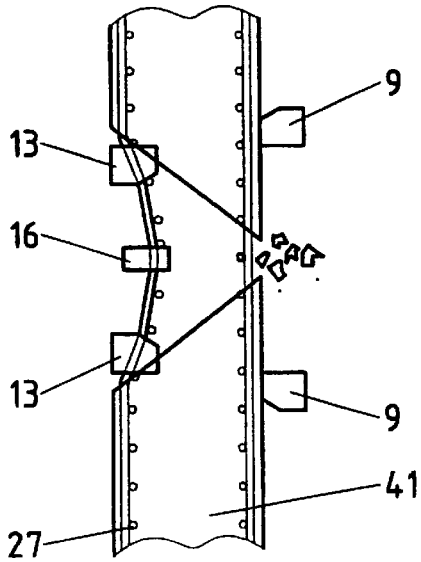
FIG. 12 shows a sectional view through the concrete-crushing pincers according to FIG. 11 taken on the line XII—XII in a diagrammatical view.

The closing movement of the concrete-crushing pincers is continued, as shown in FIGS. 11 and 12. The concrete situated in the region of the rear teeth 9 and 13 of the first pincer jaw 1 and the second pincer jaw 2 is further crushed, the front teeth 10 of the first pincer jaw are pressed against the concrete slab 41, the additional tooth 15 of the second pincer jaw 2, which is situated between the front teeth 14 and likewise projects over the latter, brings about a bending and a corresponding crushing for this area of the concrete slab 41, too, as took place in the area of the rear teeth 9 and 13. The pieces of concrete broken out are ejected through the free opening of the first pincer jaw 1.

Figure 13:
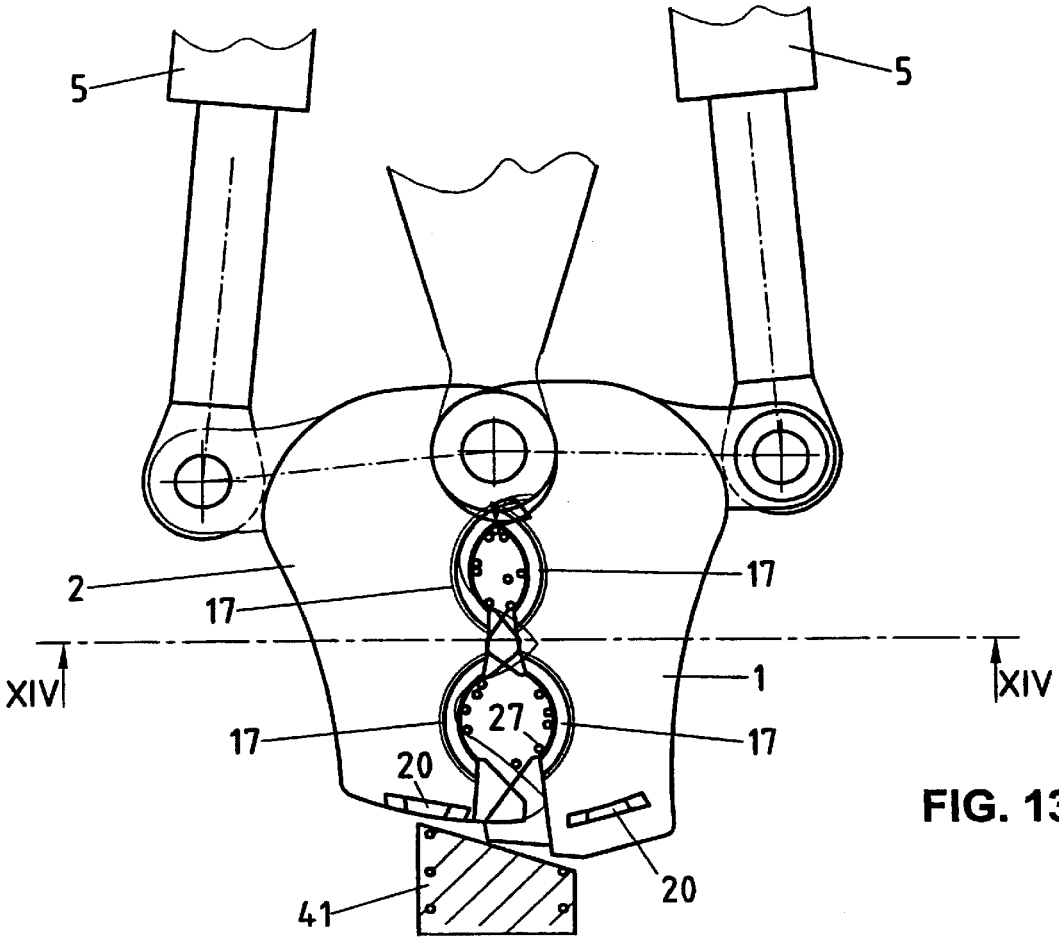
FIG. 13 shows in a diagrammatical view a view of the concrete-crushing pincers, the closing movement of which has been further continued and which are in a position shortly before cutting through the reinforcing iron.
Figure 14:
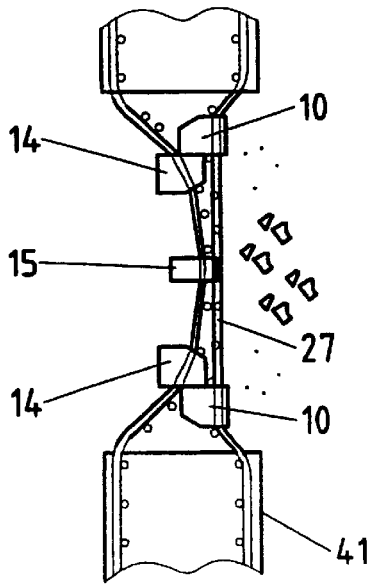
FIG. 14 shows a sectional view taken on the line XIV—XIV according to FIG. 13 diagrammatically.

The closing movement of the concrete-crushing pincers is continued, as shown in FIGS. 13 and 14. Here, the concrete-crushing operation, which has been carried out particularly by the rear teeth 9 and 13, by the front teeth 10 and 14, and by the additional teeth 15 and 16 of the first pincer jaw 1 and the second pincer jaw 2, is nearly concluded. The first cutting elements 17 and the second cutting elements 20 are only slightly involved in the concrete-crushing operation and are thus spared. The wedge shape of the teeth now causes the reinforcing iron to be pressed into the region of the first cutting elements 17, as is shown in FIG. 13. Upon further closure, the reinforcing irons 27, situated in the area of the first cutting elements 17, are now cut.

Figure 15:
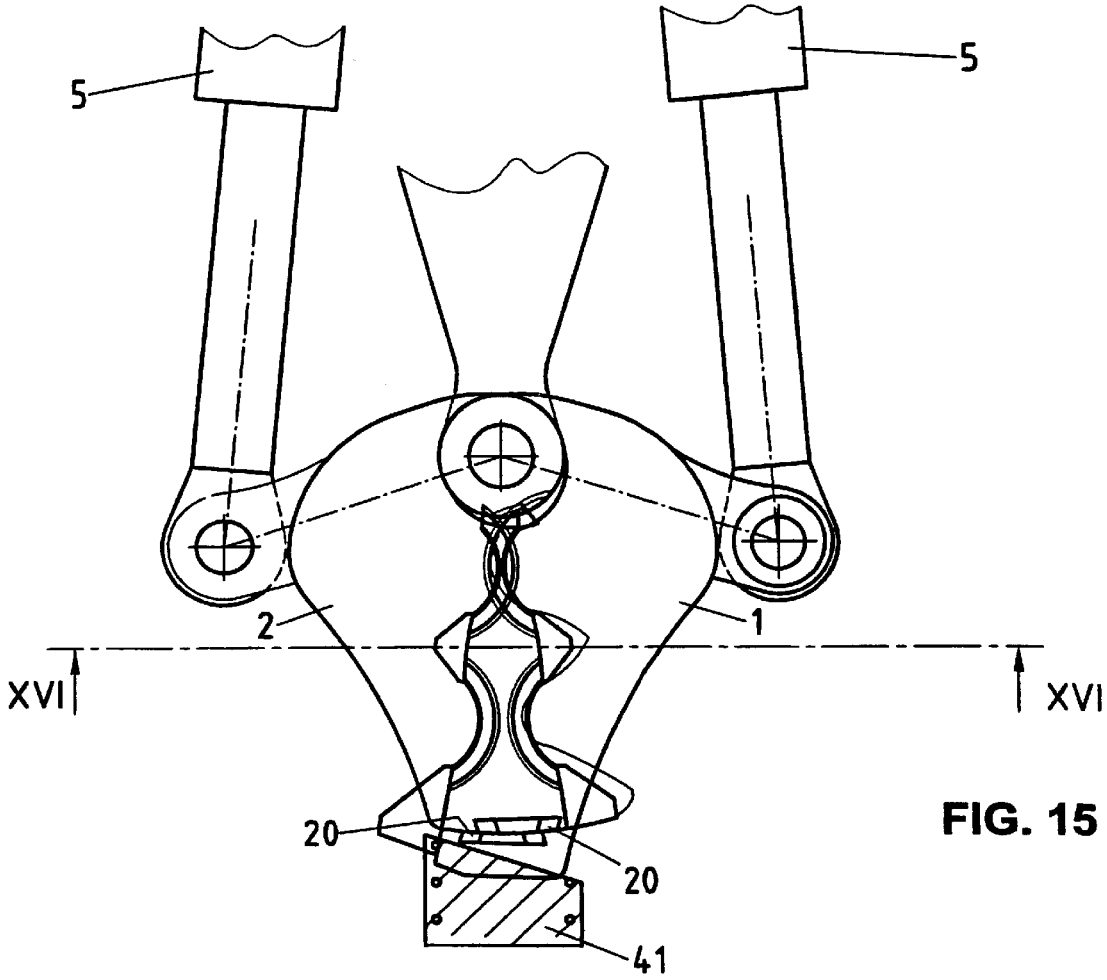
FIG. 15 shows a diagrammatical view of the concrete-crushing pincers in a completely closed state.
Figure 16:
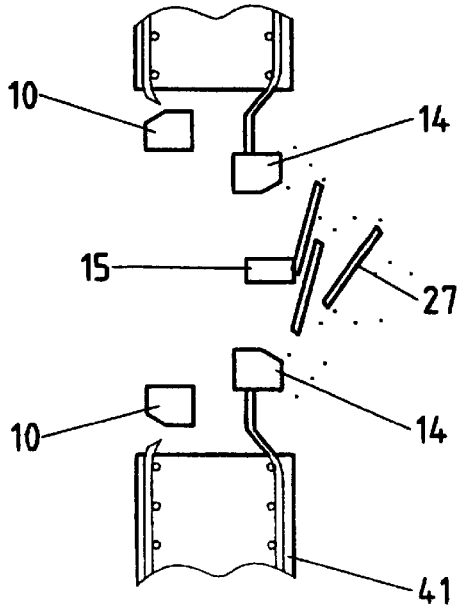
FIG. 16 shows a sectional view taken on the line XVI—XVI according to FIG. 15 with severed reinforcing iron.

Not until these first cutting elements 17 have cut the reinforcing iron 27 situated in their region do the second cutting elements 20 come into use and cut up the reinforcing irons situated in this region, which run at right angles to those which have been cut by the first cutting elements 17. This operation takes place in the last part of the closing movement of the concrete-crushing pincers according to the invention. The projections 40 of the interacting plates 21 cause the reinforcing iron to be cut to be pressed into the indentations 39, where the cutting takes place. This state is shown in FIGS. 15 and 16, where the piece of the concrete slab 41 grasped by the concrete-crushing pincers is cleanly broken out, and the reinforcing irons running lengthwise and crosswise have been cut out. The concrete-crushing pincers may be opened and applied to another location of the concrete slab 41.

The material of which the blocks 18 and the plates 21 are made consists, for example, of a steel having a hardness of about 58 HRC.

Through the arrangement described previously of the teeth and the cutting elements in the concrete-crushing pincers according to the invention, first a gradual breaking-out of the concrete is achieved, thereafter the rear part of the reinforcing irons is cut, after which the front part of the reinforcing irons is cut, and only then does the severing of the reinforcing irons situated in the end-face area of the concrete-crushing pincers take place. By means of this step-by-step procedure, optimum effectiveness of the concrete-crushing pincers can be achieved with the closing force usually mustered, the cutting edges for cutting the reinforcing irons being spared and their life thus being extended. Through the possibility of replacing the cutting elements, the concrete-crushing pincers can, when these cutting elements show too much wear and tear, be optimally equipped again in a short time, this replacement being able to take place practically at the place of use of these concrete-crushing pincers.

What is claimed is:

1. Concrete-crushing pincers comprising a first pincer jaw and a second pincer jaw which are connected to one another via a joint and are movable via hydraulic cylinders about a swivel axis formed by the joint from an open position into a closed position, wherein the first pincer jaw is formed by a frame body in which first concrete-crushing sectors and first cutting sectors are disposed, and wherein the second pincer jaw is formed by a body on which second concrete-crushing sectors and second cutting sectors are disposed, which, during closing of the concrete-crushing pincers, while the second pincer jaw penetrates into the frame body of the first pincer jaw, cooperate with the first concrete-crushing sectors and the first cutting sectors of the first pincer jaw, and the first and the second cutting sectors are formed of first and second cutting elements, respectively, which are inserted in receiving pockets respectively affixed in the first pincer jaw and the second pincer jaw and are detachably fastened therein, wherein:

the first cutting elements are fastened to the lateral areas of the first pincer jaw and the second pincer jaw; and the first cutting elements are each formed of a block provided with a bend, the convex surface of which rests in the receiving pocket provided with a corresponding support surface, and the concave surface of which, with the lateral surfaces lying in a plane standing perpendicular to the swivel axis, each form a cutting edge.

2. The concrete-crushing pincers of claim 1, further comprising:

a guide rib affixed to the convex surface of the first cutting elements that is aligned longitudinally to the convex surface and runs centrally; wherein:

a groove is furnished in the respective support surface of the receiving pocket corresponding to the guide rib, in which groove the guide rib engages.

3. The concrete-crushing pincers of claim 1, further comprising elements, provided with stop surfaces, affixed to the end regions of the support surfaces of the receiving pockets; wherein:

end faces of the blocks forming the first cutting elements rest against the stop surfaces in the state inserted in the receiving pockets; whereby:

the first cutting elements are held in the receiving pockets.

4. The concrete-crushing pincers of claim 3, further comprising:

first cutting elements disposed two at a time in a row on each lateral area of the first pincer jaw and of the second pincer jaw;

a rear tooth affixed between the two first cutting elements on the first pincer jaw and on the second pincer jaw forming the rear concrete-crushing sector;

a front tooth affixed to the end region facing away from the joint on the first pincer jaw and on the second pincer jaw forming the front concrete-crushing sector; wherein:

each rear tooth and each front tooth being screwed to the respective pincer jaw.

5. The concrete-crushing pincers of claim 4, wherein the tip of each front tooth and of each rear tooth projects over the cutting edges of the cutting elements.

6. The concrete-crushing pincers of claim 1, wherein the bend of the block forming the first cutting elements is arcuate, such that the concave surface lying between the two cutting edges has a curvature and the wedge angle is greater than 90°, and that the first cutting elements can be so rotated that one of each of the two cutting edges is in use.

7. The concrete-crushing pincers of claim 1, wherein:

the second cutting elements are fastened to the end-face area of the first pincer jaw and of the second pincer jaw;

the second cutting elements are formed substantially of a plate, the surface of which directed toward the cutting plane have a curvature, so that every point of this surface is at the same distance from the swivel axis;

this surface and the two opposing lateral surfaces adjacent thereto each form a cutting edge; and one of the two lateral surfaces of this plate rests on the support surface of the receiving pocket corresponding to this lateral surface.

8. The concrete-crushing pincers of claim 7, wherein the surface of the plate opposite the curved surface rests against a wall of the first pincer jaw and of the second pincer jaw adjoining the support surface and is screwed thereto.

9. The concrete-crushing pincers of claim 7, wherein the lateral surfaces of the plate are provided with indentations and projections.

10. The concrete-crushing pincers of claim 7, wherein the plate is insertable in the receiving pocket in such a way that one or the other of the two cutting edges can be utilized for cutting.

11. The concrete-crushing pincers of claim 7, further comprising:

first cutting elements disposed two at a time in a row on each lateral area of the first pincer jaw and of the second pincer jaw;

a rear tooth affixed between the two first cutting elements on the first pincer jaw and on the second pincer jaw forming the rear concrete-crushing sector;

a front tooth affixed to the end region facing away from the joint on the first pincer jaw and on the second pincer jaw forming the front concrete-crushing sector; wherein:

the plate is disposed in each case between the two front teeth of the first pincer jaw and of the second pincer jaw; and the tip of each tooth projects over the cutting edge of the plate.

12. The concrete-crushing pincers of claim 1, further comprising:

at least two teeth disposed on the lateral areas of the first pincer jaw and of the second pincer jaw which cooperate with one another; and an additional tooth affixed to the second pincer jaw about in the middle between each pair of teeth having substantially the same distance from the swivel axis.

13. The concrete-crushing pincers of claim 12, wherein the tip of each additional tooth projects over the tips of the two teeth which form the pair of teeth and between which each additional tooth is affixed.

14. The concrete-crushing pincers of claim 11, wherein the tip of each tooth which is affixed in each case to a lateral area of the first pincer jaw and the second pincer jaw, respectively, lie substantially on a straight line which intersects the swivel axis.

* * * * *